US007677522B2

(12) United States Patent
Bakos

(10) Patent No.: US 7,677,522 B2
(45) Date of Patent: Mar. 16, 2010

(54) SUPPORT BRACKET FOR A COLUMN

(76) Inventor: Stephen M. Bakos, 93 Broad Mountain View Dr., Jim Thorpe, PA (US) 18229

( * ) Notice: Subject to any disclaimer, the term of this patent is extended or adjusted under 35 U.S.C. 154(b) by 0 days.

(21) Appl. No.: 12/116,276

(22) Filed: May 7, 2008

(65) Prior Publication Data

US 2009/0279959 A1 Nov. 12, 2009

(51) Int. Cl.
*A47B 97/00* (2006.01)

(52) U.S. Cl. ..... 248/500; 248/354.1; 248/357; 52/294; 52/295; 52/296

(58) Field of Classification Search ..... 52/712–715, 52/295, 296, 294; 248/357, 500, 507, 354.2, 248/679

See application file for complete search history.

(56) References Cited

U.S. PATENT DOCUMENTS

| | | | | |
|---|---|---|---|---|
| 2,182,579 | A | 12/1939 | Bolton et al. | |
| 4,387,543 | A | 6/1983 | Tschan et al. | |
| 4,924,648 | A | 5/1990 | Gilb et al. | |
| 5,379,563 | A * | 1/1995 | Tinsley | 52/295 |
| 5,467,569 | A | 11/1995 | Chiodi et al. | |
| 2007/0107339 | A1 * | 5/2007 | Matsumoto | 52/295 |
| 2007/0187568 | A1 * | 8/2007 | Titus et al. | 248/576 |

* cited by examiner

*Primary Examiner*—Amy J Sterling
(74) *Attorney, Agent, or Firm*—Harold I. Masteller, Jr.

(57) ABSTRACT

A, support bracket and column for supporting an elevated structure during and after construction. The support bracket includes a connection plate that is attached to and overlapped by the column base so that the support bracket is concealed from view when construction is completed, and variations of the support bracket provide means to raise or lower the attached column during construction.

13 Claims, 6 Drawing Sheets

Fig. 5
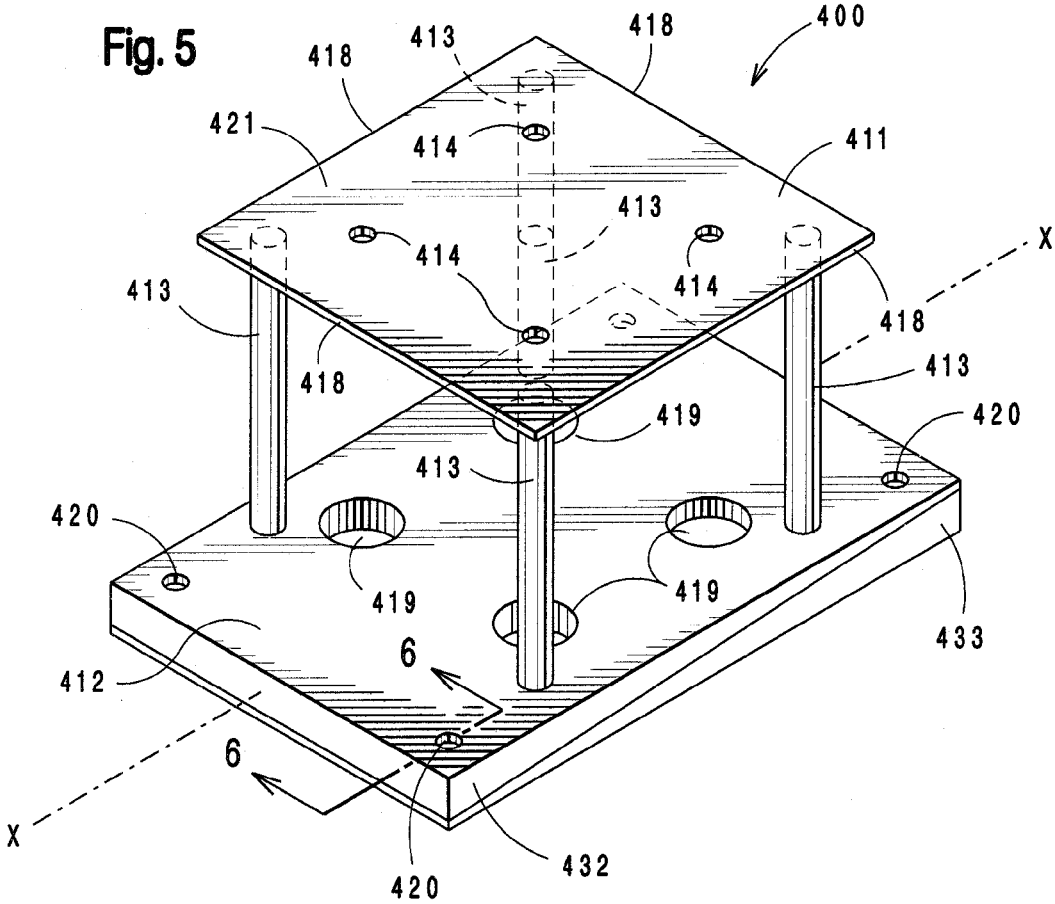
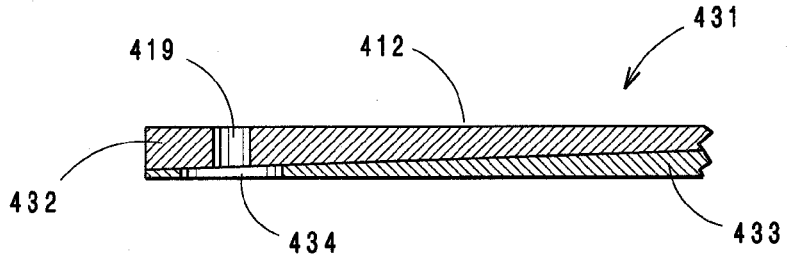
Fig. 6

SUPPORT BRACKET FOR A COLUMN

BACKGROUND

The present invention is directed to a column support bracket that fixes a permanent column at a predetermined position during the construction phase of an elevated structure, an integrated column and support bracket where the bracket is concealed from view after construction of the elevated structure is completed.

Architectural designs frequently include elevated structures, for example cantilevered decks, balconies, rooms, or the like that extend outward from the main building and require temporary support members during the construction phase. A footing or foundation wall is poured by concrete workers followed by carpenters who erect temporary bracing or framework to support the elevated structure during construction. When the structure is completed, the concrete workers and/or masons return to complete the foundation work which may include pouring a concrete slab, laying up masonry work or both. After the finish work is completed for the foundation, carpenters return to disassemble the temporary framework and erect permanent columns that support the elevated structure on the finished foundation. Such repetitive use of the labor force, and the erection of temporary framework, is inefficient in time, energy, and/or materials, and increases construction costs.

BRIEF SUMMARY OF THE INVENTION

The present invention overcomes inefficient construction practices by providing an integrated column and support bracket for use during the construction phase and for use as a permanent or finished column that conceals the support bracket from view when construction work is completed. In the preferred embodiment, the support bracket includes a top connection plate that is fixed to and is overlapped by the underside surface or base of the column, a bottom foundation plate that is fixed to a foundation, for example but not limited to a footer, wall, slab or the like, and at least one strut that extends between the top and bottom plates of the support bracket.

In one variation of the preferred embodiment, the top connection plate includes an upward extending tube member that is fixed within the hollow interior of a tubular column.

In another variation, the strut, or the plurality of struts are adjustable along the vertical axis so that the distance between the top connection plate and bottom foundation plate can be increased or decreased to position the connection plate or column base at a desired elevation.

In another variation, the support bracket foundation plate includes a sliding wedge mechanism that provides vertical adjustment to position the top connection plate or column base at a desired elevation.

As used herein, the term "column" refers to any vertical structural member capable of supporting elevated structures, including a simple square, rectangular, or round post manufactured from wood or other suitable material, a complex classical pillar such as Ionic, Doric or like column, or other suitable architectural shapes and designs including tubular columns.

The term "foundation" refers to any support structure capable of supporting calculated live and/or dead loads for a particular structure including but not limited to footers, foundations, walls, slabs, pillars, and pilings.

The term "strut" as used herein refers to a rigid structural member or stiffener that extends between the top connection plate and the bottom foundation plate of the present support bracket invention to resist compression and shear forces.

The term "hidden bracket" or "concealed bracket" refers to a column support bracket that is not visible or is hidden from view when the construction work is completed.

Accordingly, it is a first object of the present invention to provide a support bracket and/or an integrated column and support bracket for use during the construction phase of an elevated structure.

It is another object of the present invention to provide a support bracket or integrated column and support bracket that is concealed from view when construction work is completed.

It is a further object of the present invention to provide a support bracket that reduces construction cost.

It is still another object of the present invention to provide a support bracket that is adjustable in the vertical direction after installation at a construction site.

It is another object of the present invention to provide an integrated column and support bracket that provides vertical adjustment to position the column base at a desired elevation after installation at a construction site.

Specifically, this invention comprises a bracket that supports a column during construction and after construction of an elevated structure. The bracket includes a top connection plate fixed to and overlapped by the bottom surface or base of the supported column, a bottom foundation plate fixed to a structure, and at least one strut that extends between the connection plate and foundation plate. The overlapped connection plate conceals the bracket from view when construction is completed.

Another aspect of the present invention includes a column support bracket with an adjustable strut or a plurality of adjustable struts that are operated to position the connection plate or column base at a desired elevation after installation at a construction site.

Still another aspect of the present invention includes a column support bracket with a sliding wedge mechanism in the base plate that is operated to position the connection plate or column base at a desired elevation after installation at a construction site.

BRIEF DESCRIPTION OF THE DRAWINGS

FIG. 5 is an isometric view showing a support bracket with a foundation plate that includes a sliding wedge mechanism.

FIG. 6 is a cross-section along the lines 6-6 in FIG. 5.

DETAILED DESCRIPTION OF THE INVENTION

Figure 1:
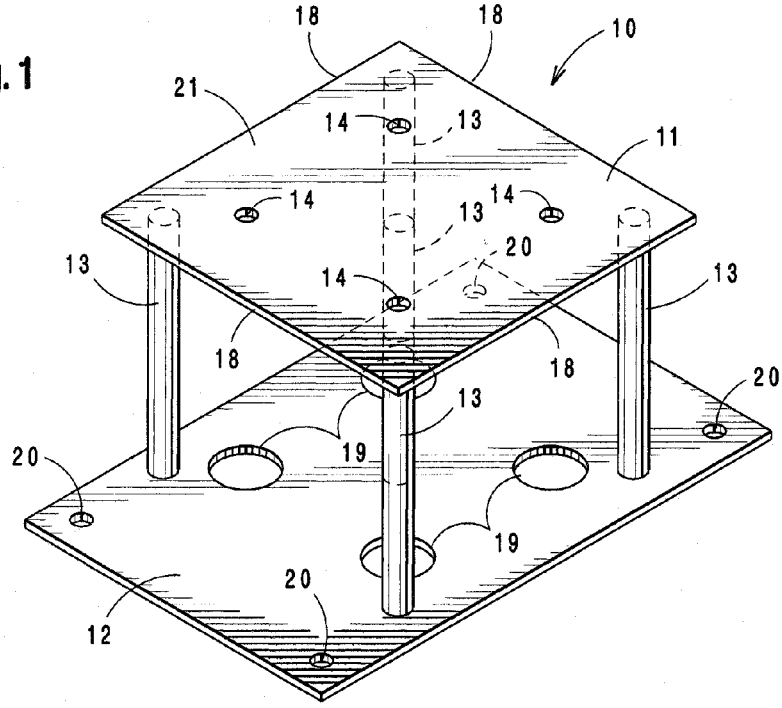
FIG. 1 is an isometric view of the preferred embodiment of the present support bracket invention.

Referring to the drawings, FIG. 1 shows one embodiment of the present invention comprising a support bracket 10 that includes a top connection plate 11, a bottom foundation plate 12 and one or more struts 13 fixed to and extending between the connection plate and foundation plate. Connection plate 11 includes an arrangement of apertures 14 that accommodate fasteners 215 for fixing the connection plate to the underside surface or base 216 of column 217 (FIGS. 7-10). A set of apertures 19 in the foundation plate are aligned with apertures 14 in the connection plate to provide tool access for driving fasteners 215 into the base of column 17. Foundation plate 12 includes a second set of apertures 20 for attaching the foundation plate to a foundation using fasteners suited for the particular foundation installed at the jobsite.

The surface area 21 of the connection plate is less than the base surface area of column 217 so that the column overlaps the connection plate periphery 18 when the plate is fixed to the underside of the column. The attached, overlapped support bracket 10 provides an integrated column and support bracket. As explained in greater detail below (FIGS. 7-10), the integrated column supports an elevated structure during and after construction, and because the support bracket is only fixed to the underside surface of the column base, it is concealed from view when the foundation finish work is completed at the jobsite.

Figure 2:
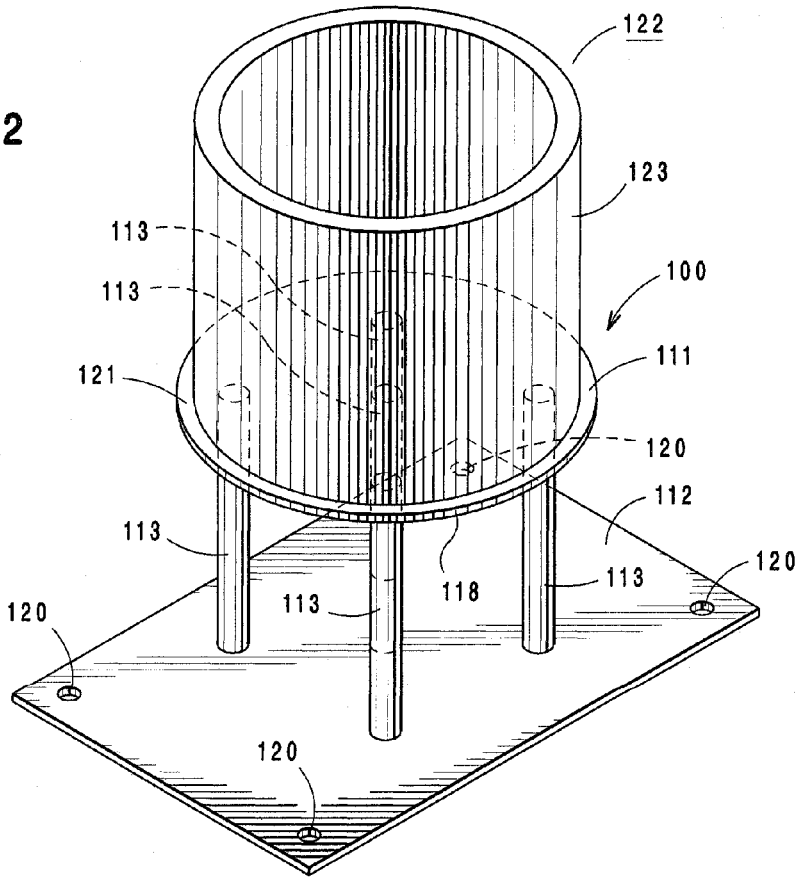
FIG. 2 is an alternate embodiment of the support bracket in FIG. 1 adapted for use with a round column.

FIG. 2 shows an alternate embodiment of the present invention comprising a support bracket 100 that includes a top connection plate 111, a bottom foundation plate 112 and one or more struts 113 fixed to and extending between the connection plate and foundation plate.

Similar to above, the foundation plate 112 includes an arrangement of apertures 120 to attach the plate to a foundation using fasteners suited for the particular foundation material found at the jobsite. However, in this embodiment, connection plate 111 includes a tubular member 122 that extends in an upward direction from connection plate to accommodate a tubular column (not shown). The outside surface 123 of the tubular member is sized to provide a "Locational Clearance Fit" as defined by ANSI Standard Tolerances whereby tubular member 122 has a snug fit within the tubular column. Such snug fits provide freedom of assembly and enable the application of a construction adhesive between surface 123 and the inside surface of the tubular column. The adhesive permanently bonds the two components into an integrated column and support bracket similar to the embodiment described for FIG. 1. The bonding adhesive may be an epoxy or other suitable adhesive, or alternatively, if the column and the tubular member 122 are manufactured from plastic materials, a solvent is used to weld the two mating surfaces together. In addition, while FIG. 2 shows a round tubular member 122 for insertion into a round column, it should be understood that tubular member 122 and corresponding column may comprise a square, rectangular, triangular, or other geometric shape without departing from the scope of the invention.

The surface area 121 of connection plate 111 is less than the underside surface area of the tubular column so that the column overlaps the connection plate periphery 118 when tubular member 122 is fixed within the column. The overlapped connection plate provides an integrated column and support bracket that can be used as a permanent support during and after the construction of an elevated structure, and the overlapping tubular column conceals the integrated support bracket from view when construction is completed at the jobsite, similar to the final step shown in FIG. 10.

Figure 3:
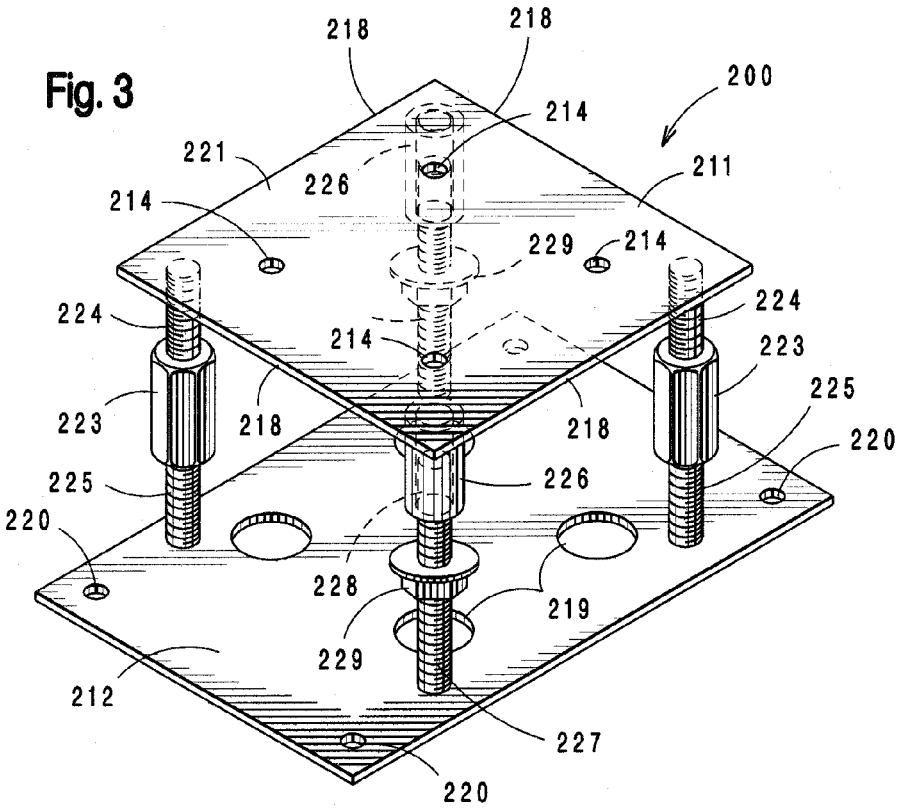
FIG. 3 is an isometric view of the support bracket showing a plurality of adjustable struts.

FIG. 3 shows another variation of the present support bracket invention 200 comprising a top connection plate 211 with apertures 214 for attaching the plate to the underside surface or base 216 of a column, and a bottom foundation plate 212 with apertures 219 that provide tool access for attaching the connection plate to the column base, and apertures 220 for fasteners that attach plate 212 to a foundation.

The struts 213 that extend between the connection plate and the foundation plate are adjustable so that the distance between plates 211 and 212 can be increased or decreased. This provides means to either raise or lower the elevation of connection plate 211 after plate 212 is fixed to a foundation. At least one of the struts 213 comprises an adjustment mechanism similar to a turnbuckle where the mechanism includes a head 223 threaded to receive a left hand thread stub end 224 and a right hand thread stub end 225. The remaining struts, herein after referred to as retainer struts, prevent accidental movement of the connection plate 211 after the plate is adjusted to a desired elevation. Each retainer strut includes a collar 226 that extends downward from and is fixed to the bottom surface of connection plate 211, a threaded rod having a first end 227 fixed to the foundation plate 212 and a second end 228 enclosed, with a running or sliding fit, within collar 226, and a locknut 229 that is seated against the bottom surface of collar 226 to restrict connection plate movement in its adjusted position and provide additional resistance to compression and shear when supporting a column.

Similar to the above the descriptions, the surface area 221 of connection plate 211 is less than the underside surface area of the supported column so that the column overlaps the connection plate periphery 218 when the connection plate is fixed within the bottom or underside surface of the column. The overlapped connection plate provides an integrated column and support bracket that can be adjusted to position the connection plate 211 or column base at a desired elevation after the foundation plate is fixed to a structure during construction, and the overlapping column conceals the integrated support bracket from view when construction work is completed at the jobsite.

Figure 4:
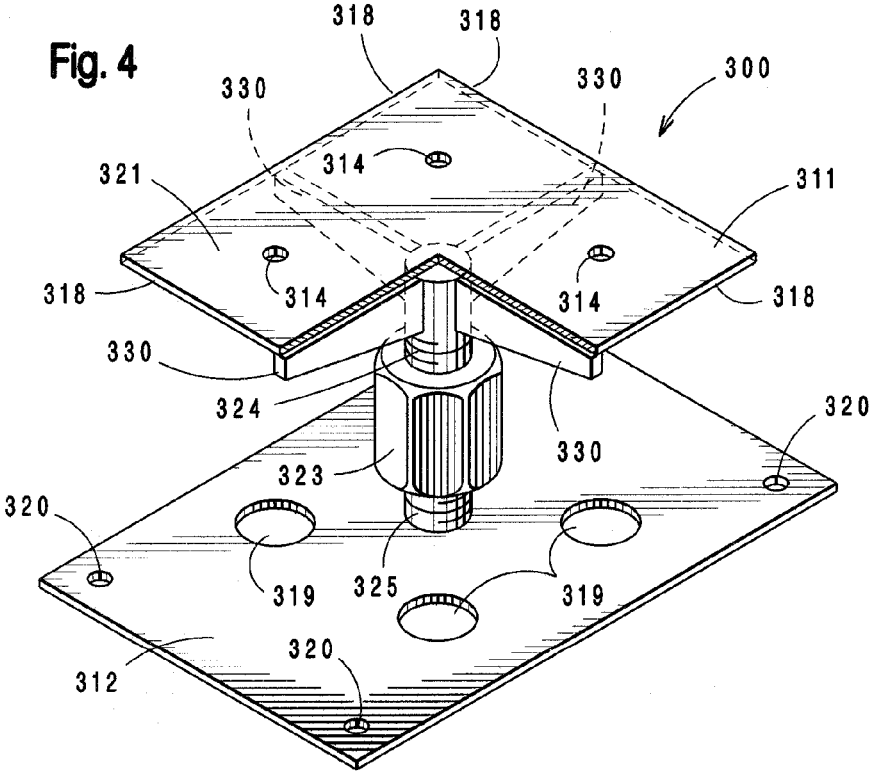
FIG. 4 is an isometric view showing the support bracket with a single adjustable strut.

FIG. 4 shows another embodiment of the present support bracket invention 300 comprising a top connection plate 311 with apertures 314 for attaching the connection plate to the underside surface or base of a column, and a bottom foundation plate 312 with apertures 319 that provide tool access for driving fasteners through the connection plate apertures 214 and into the column base, and apertures 220 for fasteners that attach plate 212 to a foundation. A single adjustable strut 313 extends between the connection plate and the foundation plate to increase or decrease the distance between plates 211 and 212 and position connection plate 211 or column base at a desired elevation after the foundation plate 212 is fixed to a structure. Strut 313 comprises an adjustment mechanism similar to a turnbuckle that includes a head 323 threaded to receive a left hand thread stub end 324 and a right hand thread stub end 325. Stiffener plates 330 are attached to the stub end 324 and connection plate 311 to provide stabilization and resistance compression and shear forces generated by construction activity.

As before, the surface area 321 of connection plate 311 is less than the underside surface or base area of the supported column so that the column completely overlaps the connection plate periphery 318 when the connection plate is fixed to the base of the column. The overlapped connection plate provides an integrated column and support bracket that can be adjusted to position the connection plate or column base at a desired elevation when the foundation plate is fixed to a structure and while the column is used as a support for an elevated structure during construction. The overlapping column conceals its integrated support bracket from view when construction work is completed at the jobsite.

FIGS. 5 and 6 show an adjustable support bracket invention 400 with a sliding wedge mechanism 431 for raising or lowering the connection plate 411 or column base to a desired elevation. Connection plate 411 includes apertures 414 for attaching the connection plate to the underside surface or base of a column as described in the above embodiments, and a bottom foundation plate assembly 412 includes a sliding wedge mechanism 431. The sliding wedge includes at least two wedge shaped plates 432 and 433 that are positioned to slide against each other in two directions along the length or x-axis of the foundation plate assembly 412. The first or top wedge plate 432 includes apertures 419 to receive fasteners that fix the plate assembly to a foundation. Apertures 419 are aligned with corresponding elongated apertures 434 that extend through the last or bottom wedge plate 433. When used as an integrated support bracket for a column, fasteners are driven through apertures 419 and 434 and into a foundation, but the fasteners are not driven home. The loosely driven fasteners hold the first wedge plate 432 in a fixed position on the foundation while the elongated apertures 434 enable the last or bottom wedge plate 433 to slide along the x-axis to raise or lower the connection plate 411 or column base to a desired elevation. The fasteners are driven home to fix the entire foundation plate assembly 412 to the foundation after elevation is properly adjusted.

One or more struts 413 extend between the connection plate and the foundation plate assembly to resist compression and shear forces encountered during construction. As heretofore described above, the surface area 421 of connection plate 411 is less than the underside surface or base area of the supported column so that the column completely overlaps the connection plate periphery 418 when the connection plate is fixed within the column base. The overlapped connection plate provides an integrated column and support bracket that can be adjusted to position connection plate 411 at a desired elevation while the column is used as a support for an elevated structure during construction, and the overlapping column conceals its integrated support bracket from view when construction work is completed at the jobsite.

FIGS. 7-10 show the present integrated column and support bracket invention in use during construction of an elevated structure and after construction is completed. It should be understood, however, that although FIGS. 7-10 show the adjustable support bracket 200 in FIG. 3, any one of the preceding bracket embodiments may be used in a manner similar to the following description.

Figure 7:
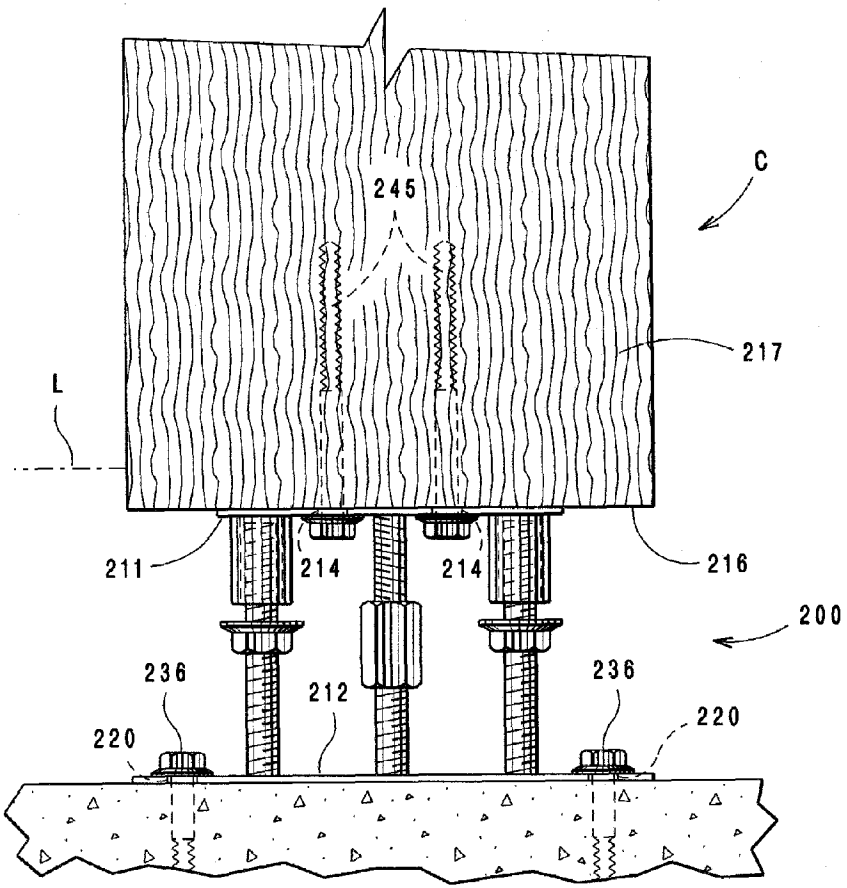
FIG. 7 is an elevation view of the support bracket in FIG. 3 positioned on a foundation.

Referring to FIG. 7, the top connection plate 211 of support bracket 200 is fixed to the underside surface or base 216 of column 217 with fasteners 245 driven through apertures 214 and into the column to provide an integrated column and support bracket "C." The foundation plate 212 is placed at a location along a foundation and fasteners 236 are driven through apertures 220 in the foundation plate to fix the plate to the foundation structure 237. An elevation or level line "L" is established for the underside surface or base 216 of the integrated column "C."

Figure 8:
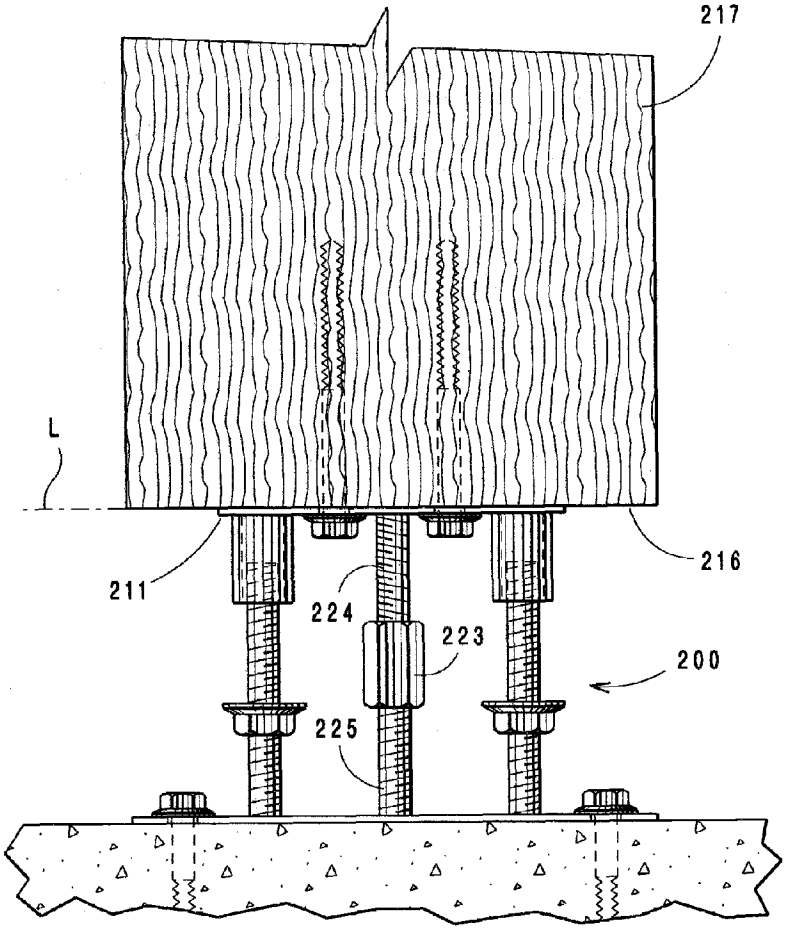
FIG. 8 shows the support bracket adjusted to a desired elevation.
Figure 9:
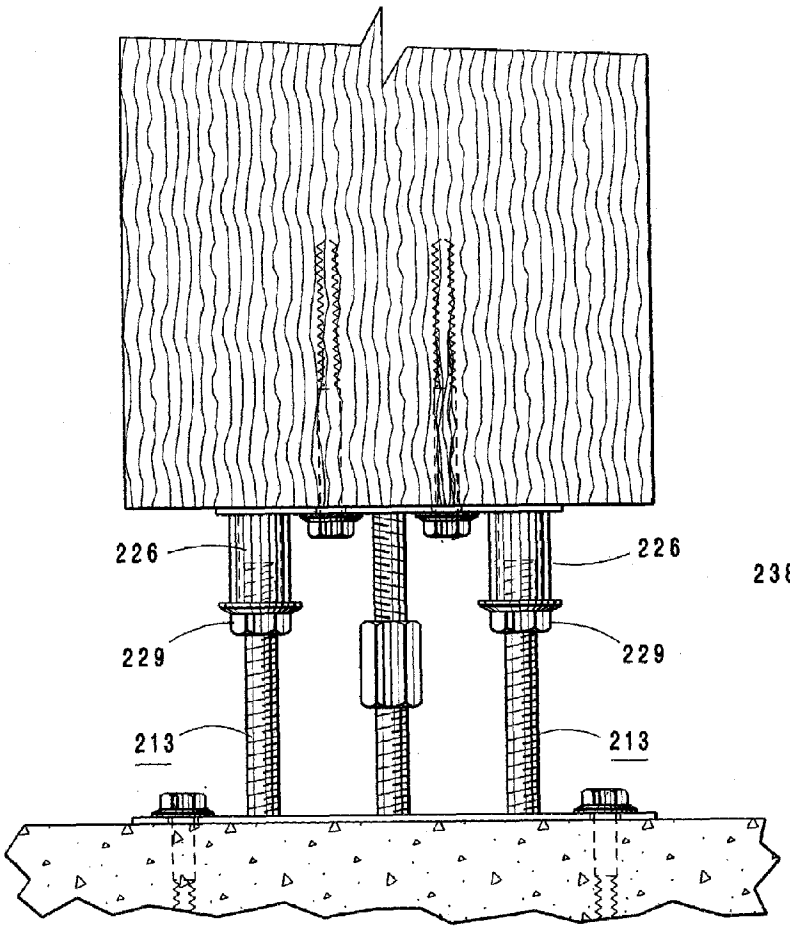
FIG. 9 shows the support bracket locked to restrict connection plate movement.

Referring to FIG. 8, head 223 of the turnbuckle strut is rotated to extend or retract the threaded stub ends 224 and 225 so that the column base 216 is adjusted to the desired elevation "L." In this instance, head 223 is rotated to extend the stub ends and raise the top surface of connection plate 211 along with the column base to elevation "L." After the column base is adjusted to elevation, the locknuts 229 in the remaining struts 213 are rotated to bear against the bottom surface of collars 226 as shown in FIG. 9. The locknuts fix the position of connection plate 211 and prevent accidental movement out of elevation during construction, and the retainer struts increase resistance to compression and shear forces generated during the construction of the supported elevated structure (not shown). As mentioned in the description for FIG. 3, support bracket 200 may include more than one turnbuckle like strut.

Figure 10:
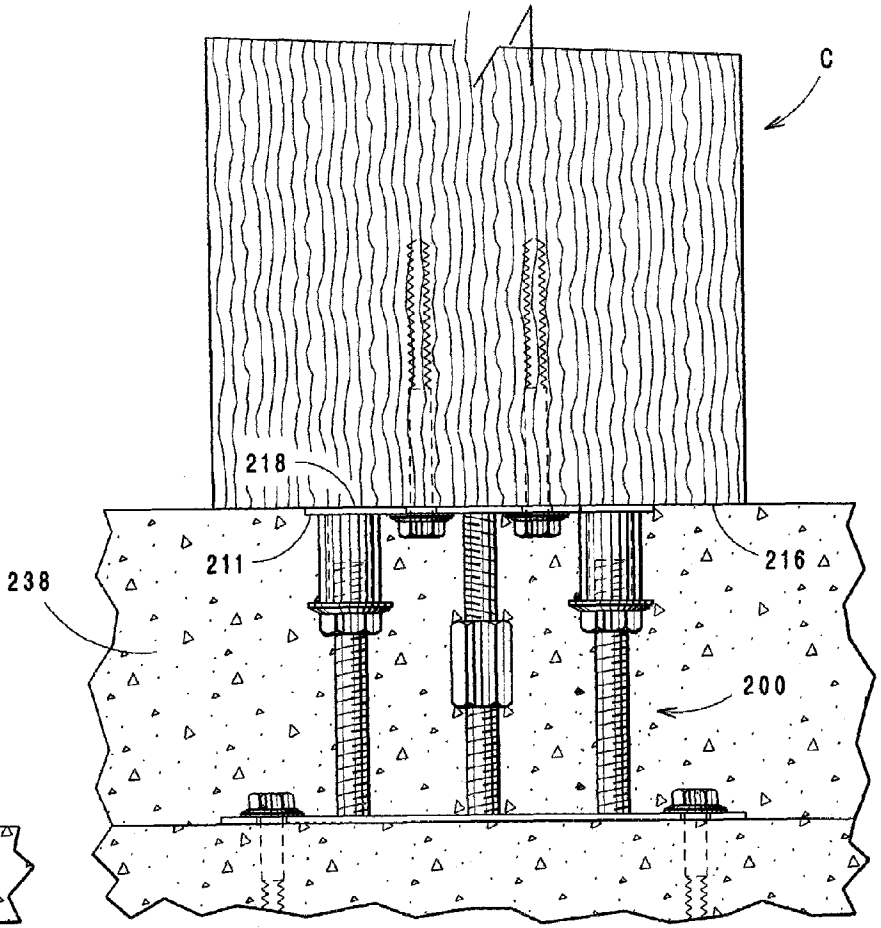
FIG. 10 shows the support bracket concealed from view after construction is completed.

Referring to FIG. 10, after construction of the elevated structure is completed, concrete workers and/or masons return to the jobsite to complete the supporting foundation by providing a finished foundation 238 which may include, but is not limited to, a concrete slab, masonry work or both. The various components of support bracket 200 that extend below the top surface area 218 of the connection plate 211 are embedded in the finished foundation structure 238. The top surface 218 of the connection plate is overlapped by the underside surface or base 216 of the column and therefore, the entire support bracket 200 is concealed from view when the finish work for the elevated structure is completed. Because the integrated column "C" is used during and after construction of the elevated structure, it is not necessary to recall carpenters to the job site to remove temporary bracing and install permanent support columns. Such streamlined construction operations save both time and cost.

Figure 11:
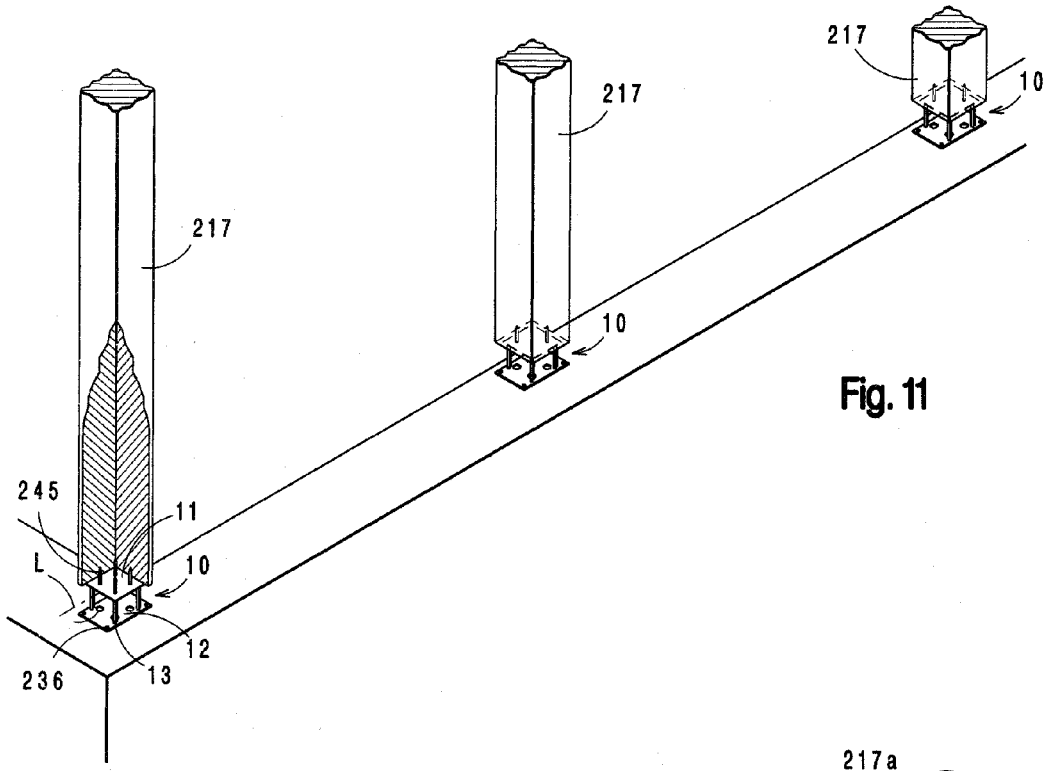
FIG. 11 shows a plurality of support brackets and attached columns spaced apart along a foundation.

FIG. 11 shows a plurality of support brackets 10 spaced apart along an unfinished foundation so that each connection plate 11 is positioned at the desired elevation "L" as heretofore described. Each connection plate 11 is fixed to the underside base of its respective column 217 with suitable fasteners 245 and each foundation plate 12 is fixed to the foundation with fasteners 236. Struts 13 extend between the connection plate and foundation plate to provide a rigid structural member.

Figure 12:
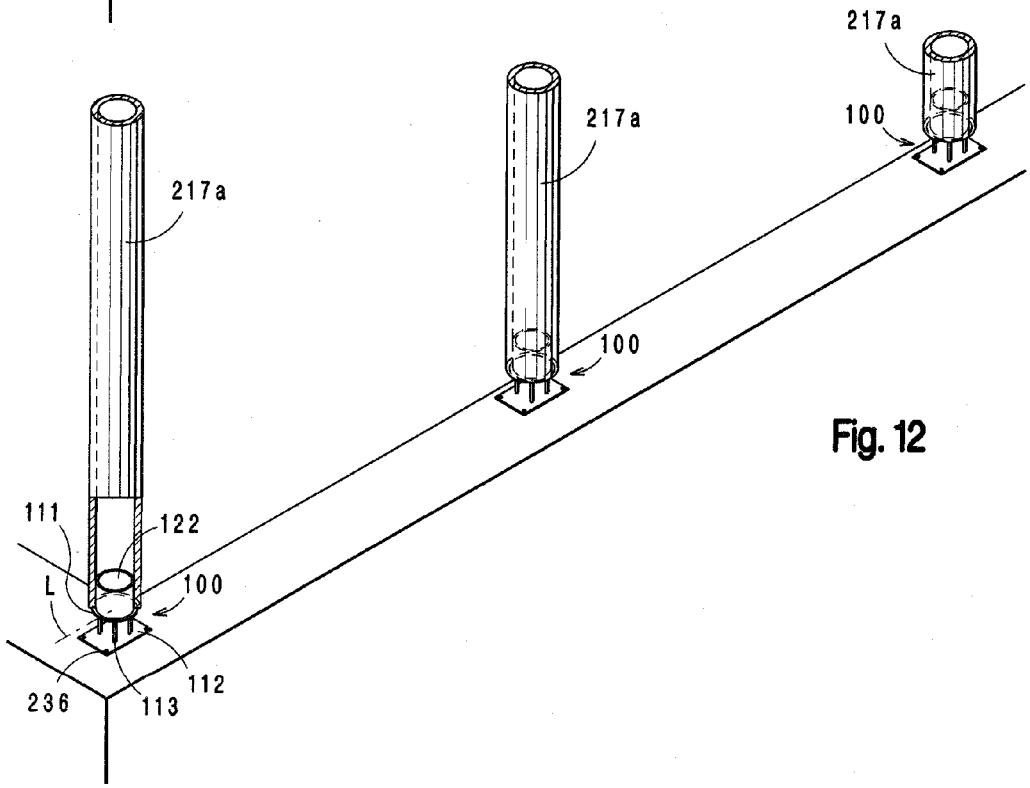
FIG. 12 shows a plurality of support brackets and attached tubular columns spaced apart along a foundation.

FIG. 12 shows a plurality of support brackets 100 spaced apart along an unfinished foundation so that each connection plate 111 is positioned at the desired elevation "L" as heretofore described. Each connection plate 111 includes a tubular or round member 122 that is inserted into a respective tubular column 217*a* and bonded thereto using any suitable adhesive. Each foundation plate 112 is fixed to the foundation with fasteners 236 and struts 13 extend between the connection plate and foundation plate to provide a rigid structural member.

As such, an invention has been disclosed in terms of preferred embodiments and alternate embodiments thereof, which fulfills each one of the objects of the present invention as set forth above and provides an integrated column and support bracket for use during and after construction of an elevated structure where the entire support bracket is concealed from view when construction of the elevated structure is completed. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A method for supporting an elevated, cantilevered architectural structure with a concealed support bracket, comprising:

providing a plurality of support brackets, each support bracket comprising a connection plate opposite a foundation plate and at least one rigid strut extending between and fixed to the bottom surface of said connection plate and the top surface of said foundation plate;

fixing with a fastener means, each connection plate to an underside surface of a column base to provide a plurality of integrated column and support bracket assemblies, each said column base underside surface overlapping the periphery of each said connection plate and concealing each said connection plate and fastener means from view;

placing each integrated assembly at a location on an unfinished foundation;

positioning each connection plate at a desired elevation;

fixing the foundation plate of each integrated assembly to the unfinished foundation;

supporting the elevated, cantilevered architectural structure with the column portion of each integrated assembly, said at least one rigid strut resisting compressive and shear forces generated by the supported structure and preventing connection plate movement away from said desired elevation position;

finishing the foundation to correspond with the desired elevation and imbedding the support bracket of each integrated assembly within the finished foundation, whereby the steps imbedding and overlapping conceal the support bracket and related fastener means from view; and continuing to support the elevated, cantilevered architectural structure on the column portion of the integrated assembly after construction is completed.

2. The method for supporting the elevated, cantilevered architectural structure recited in claim 1, comprising: positioning each said connection plate at the desired elevation before said foundation plate is fixed to the unfinished foundation.

3. The method for supporting the elevated, cantilevered architectural structure recited in claim 1, comprising: positioning each said connection plate at the desired elevation after said foundation plate is fixed to the unfinished foundation.

4. The method for supporting the elevated, cantilevered architectural structure recited in claim 3, wherein said connection plate is positioned at the desired elevation by increasing or decreasing the length of said at least one rigid strut.

5. The method for supporting the elevated, cantilevered architectural structure recited in claim 4, wherein said step increasing or decreasing the length of said at least one rigid strut comprises rotating a threaded head and extending or retracting from said threaded head a first threaded rod fixed to said top surface of the foundation plate and a second threaded rod fixed to said bottom surface of the connection plate.

6. The method for supporting the elevated, cantilevered architectural structure recited in claim 4, comprising fixing said connection plate at said desired elevation by engaging a lock device that prevents increasing, or decreasing the length of said at least one rigid strut.

7. The method for supporting the elevated, cantilevered architectural structure recited in claim 3, whereby said connection plate is positioned at said desired elevation by adjusting a wedge arrangement integral with the foundation plate.

8. A method for supporting an elevated architectural structure with a concealed support bracket and column assembly, the steps of the method, comprising:

providing at least one support bracket and column assembly, the support bracket comprising a connection plate opposite a foundation plate and at least one rigid strut extending between and fixed to said connection plate and said foundation plate, the column comprising a top end and a base end, said base end fixed to and overlapping the periphery of said connection plate and concealing said connection plate and a fastener structure from view to;

placing said at least one support bracket and column assembly on an unfinished foundation;

positioning said connection plate at a desired elevation;

fastening the foundation plate to the unfinished foundation;

supporting the elevated architectural structure at the top end of said column during construction, said at least one rigid strut resisting compressive and shear forces generated by the supported architectural structure;

finishing the foundation to correspond with said desired elevation and imbedding the support bracket therein, the overlapping column base concealing the imbedded support bracket from view.

9. The method for supporting the elevated architectural structure recited in claim 8, comprising positioning the connection plate at the desired elevation after said support bracket is fastened to the unfinished foundation.

10. The method for supporting an elevated architectural structure recited in claim 8, comprising positioning the connection plate at the desired elevation before said support bracket is fastened to the unfinished foundation.

11. The method for supporting the elevated architectural structure recited in claim 9, comprising adjusting the length of said at least one rigid strut to position said connection plate at the desired elevation.

12. The method for supporting the elevated, cantilevered architectural structure recited in claim 1, comprising; fixing each connection plate to the underside surface of the column base by inserting fasteners through apertures in said connection plate and driving the fasteners into the column base.

13. The method for supporting the elevated, cantilevered architectural structure recited in claim 1, comprising; fixing each connection plate to the underside surface of a tubular column base by inserting an upward extending portion of said connection plate into the tubular column base and bonding said connection plate thereto.

* * * * *